US010215064B2

(12) United States Patent
Daimon et al.

(10) Patent No.: US 10,215,064 B2
(45) Date of Patent: Feb. 26, 2019

(54) COMPOSITE PROFILE EVALUATING METHOD AND COMPOSITE PROFILE MEASURING DEVICE

(71) Applicant: HONDA MOTOR CO., LTD., Tokyo (JP)

(72) Inventors: Yuta Daimon, Tochigi-ken (JP); Fumio Sato, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 170 days.

(21) Appl. No.: 15/458,445

(22) Filed: Mar. 14, 2017

(65) Prior Publication Data

US 2017/0268390 A1 Sep. 21, 2017

(30) Foreign Application Priority Data

Mar. 18, 2016 (JP) ..... 2016-055600

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/18*** | (2006.01) |

(52) U.S. Cl.

CPC ..... *F01L 1/34413* (2013.01); *F01L 1/047* (2013.01); *F01L 1/18* (2013.01); *F01L 2001/0473* (2013.01); *F01L 2820/041* (2013.01)

(58) Field of Classification Search

CPC ..... F01L 1/34413; F01L 1/047; F01L 1/18; F01L 2001/0473; F01L 2820/041

See application file for complete search history.

(56) References Cited

U.S. PATENT DOCUMENTS 8,225,762 B2 * 7/2012 Lancefield ..... F01L 1/047 123/90.17

FOREIGN PATENT DOCUMENTS

| | | |
|---|---|---|
| JP | 07-190702 | 7/1995 |
| JP | 2002-054410 | 2/2002 |

* cited by examiner

*Primary Examiner* — Zelalem Eshete

(74) *Attorney, Agent, or Firm* — Rankin, Hill & Clark LLP

(57) ABSTRACT

A composite profile evaluating method includes an adjusting step and a composite profile detecting step. In the adjusting step, a relative position between a fixed cam and a movable cam is adjusted. In the composite profile detecting step, at least either one of a first contact element, which is displaced along a diametrical direction of the fixed cam upon contacting a cam surface of the fixed cam, and a second contact element, which is displaced integrally with the first contact element and along a diametrical direction of the movable cam upon contacting a cam surface of the movable cam, is brought into contact with the cam surface of the fixed cam or the movable cam. In such a state, the composite profile is obtained by rotating the fixed cam and the movable cam, and detecting the amounts of displacement of the first and second contact elements.

4 Claims, 4 Drawing Sheets

COMPOSITE PROFILE EVALUATING METHOD AND COMPOSITE PROFILE MEASURING DEVICE

CROSS-REFERENCE TO RELATED APPLICATION

This application is based upon and claims the benefit of priority from Japanese Patent Application No. 2016-055600 filed on Mar. 18, 2016, the contents of which are incorporated herein by reference.

BACKGROUND OF THE INVENTION

Field of the Invention

The present invention relates to a composite profile evaluating method and a composite profile measuring device for a camshaft that opens and closes an engine valve provided in a cylinder of an internal combustion engine, in accordance with a composite profile corresponding to the relative positioning of a pair of a fixed cam and a movable cam.

Description of the Related Art

For example, in Japanese Laid-Open Patent Publication No. 07-190702, there is proposed an inspection method for a camshaft having cams of the same shape and same phase. More specifically, contact elements, which are capable of moving in a direction perpendicular to an axis of the camshaft, are brought into contact with the circumferential surfaces of the aforementioned two cams, and the camshaft is rotated in this state. In accordance therewith, it is determined that the smaller the amount of relative movement of, both contact elements to be detected, the higher the dimensional accuracy and assembly accuracy of the cams becomes.

Incidentally, for example, according to Japanese Laid-Open Patent Publication No. 2002-054410, in order to arbitrarily control the opening angles of engine valves of an internal combustion engine, instead of cams of the same shape and same phase, a camshaft has been proposed which comprises movable cams and fixed cams for which the relative positioning (phase difference) therebetween is variable.

With such a camshaft, since the phases of the fixed cams and the movable cams are not limited to being mutually the same, even if the detection method of Japanese Laid-Open Patent Publication No. 07-190702 were applied thereto, it would be difficult to evaluate the state of the cam surfaces. Consequently, it is indispensable to evaluate the state of respective cam surfaces separately, by bringing contact elements into abutment against each of the fixed cams and the movable cams.

SUMMARY OF THE INVENTION

With a camshaft equipped with fixed cams and movable cams as described above, the same rocker arm is driven by one pair of a fixed cam and a movable cam, which are disposed adjacent to each other along the axial direction of the camshaft. With such a configuration, a composite profile of the fixed cam and the movable cam serves to drive the valve, and since the cam profile can be made variable in a simulated manner, it is possible for an extremely complex valve control to be performed.

In this manner, in the case that an engine valve is driven by the composite profile of the fixed cam and the movable cam, it is necessary to evaluate the composite profile. However, as noted above, with a method in which contact elements are brought into contact separately with the fixed cam and the movable cam, even though it is possible to evaluate the respective profiles of the fixed cam and the movable cam, it is not possible to perform an evaluation of the actual composite profile.

Thus, it may be considered to perform such an evaluation by synthetically obtaining the composite profile by calculating the respective profiles of the fixed cam and the movable cam. However, in this case, profiles are each measured respectively from the fixed cam and the movable cam, and a computational process or the like to combine the profiles is required, resulting in a number of complex steps. Further, if an error occurs between the actual composite profile and the composite profile obtained by calculation, the accuracy of the evaluation decreases.

A principal object of the present invention is to provide a method of evaluating a composite profile, which enables the composite profile of a fixed cam and a movable cam to be evaluated easily and highly accurately.

Another object of the present invention is to provide a composite profile measuring device, which is capable of evaluating the composite profile of a fixed cam and a movable cam easily and highly accurately.

According to an embodiment of the present invention, there is provided a method of evaluating a composite profile of a camshaft that opens and closes an engine valve provided in a cylinder of an internal combustion engine, in accordance with a composite profile corresponding to a relative position of a pair of a fixed cam and a movable cam, wherein in the camshaft, an inner shaft is rotatably arranged in interior of a cylindrical outer shaft on which the fixed cam is provided on an outer circumference thereof, and the movable cam is fixed to the inner shaft through a notch of the outer shaft, the method comprising an adjusting step of adjusting the relative position of the fixed cam and the movable cam, by rotating the inner shaft relatively with respect to the outer shaft, and rotating the movable cam together with the inner shaft while sliding along an outer circumferential surface of the outer shaft, and a composite profile detecting step of obtaining the composite profile, by rotating the outer shaft and the inner shaft, while at least one of a first contact element, which is displaced along a diametrical direction of the fixed cam by contacting a cam surface of the fixed cam, and a second contact element, which is displaced integrally with the first contact element together with being displaced along a diametrical direction of the movable cam by contacting a cam surface of the movable cam, is placed in contact with the cam surface of the fixed cam or the movable cam, and by detecting with a displacement amount detecting unit displacement amounts of the first contact element and the second contact element.

In the method of evaluating a composite profile according to the present invention, as noted above, the first contact element is displaced along a diametrical direction of the fixed cam by being placed in contact with the cam surface of the fixed cam, and the second contact element is displaced along a diametrical direction of the movable cam by being placed in contact with the cam surface of the movable cam. Further, since the first contact element and the second contact element are mutually and integrally displaced, when either one of them is displaced, the other one is also displaced in accordance with the displacement thereof.

Consequently, in a state in which the phases of the fixed cam and the movable cam are shifted, within the cam surface of the movable cam, the second contact element contacts only the portion whose phase is shifted from the fixed cam, and in this manner, the first contact element is separated from the fixed cam only within an area where the second contact element contacts the movable cam. Stated otherwise, the first contact element can be made to contact only that portion where the profile of the cam surface of the fixed cam is used, and the second contact element can be made to contact only that portion where the profile of the cam surface of the movable cam is used.

In other words, since it is possible for displacement amounts corresponding to the actually used composite profile of the fixed cam and the movable cam to be detected by the displacement amount detecting unit, the composite profile can be directly measured and evaluated. Accordingly, because there is no need to perform a calculating process or the like to combine the profiles of the fixed cam and the movable cam which are measured respectively, the composite profile can be obtained easily and efficiently, and with high precision.

Consequently, for example, by comparing the composite profile that was measured in the foregoing manner, and a set value for the composite profile determined based on the relative position (phase difference) of the fixed cam and the movable cam, it is possible to evaluate easily and with high precision the assembly accuracy and dimensional accuracy, etc., of the camshaft.

In the above-described method of evaluating the composite profile, there preferably are further included a phase detecting step of detecting respective rotational phases of the outer shaft and the inner shaft, during rotation of the outer shaft and the inner shaft in the composite profile detecting step, a phase difference calculating step of calculating, by a calculating unit, a phase difference between rotational phases of the outer shaft and the inner shaft, which were detected in the phase detecting step, and a recording step of recording the composite profile detected in the composite profile detecting step, and the phase difference calculated in the phase difference calculating step, the composite profile and the phase difference being associated with each other.

Because the fixed cam rotates together with the outer shaft and the movable cam rotates together with the inner shaft, the phase difference between the rotational phases of the outer shaft and the inner shaft corresponds to the relative position of the fixed cam and the movable cam. Further, the composite profile is determined on the basis of the relative position of the fixed cam and the movable cam. Consequently, by associating with each other and recording the phase difference based on the rotational phases of the outer shaft and the inner shaft as actually detected, and the composite profile of the fixed cam and the movable cam, it is possible to evaluate with higher precision the assembly accuracy and the dimensional accuracy, etc., of the camshaft.

In the above-described method of evaluating the composite profile, by performing the adjusting step and the composite profile detecting step a plurality of times, within a variable range of the relative positions between the pair of the fixed cam and the movable cam, composite profiles preferably are obtained, respectively, for each of a plurality of the relative positions within the variable range. In this instance, the variable range is a range from a state in which the phases of one pair of the fixed cam and the movable cam coincide with each other, and until the shift in the phase becomes maximum. In this manner, concerning the one pair of the fixed cam and the movable cam, by measuring the composite profile of each of the plurality of relative positions within the variable range, it is possible to evaluate with higher precision the assembly accuracy and dimensional accuracy, etc., in conformance with the actual state of use of the camshaft.

According to another embodiment of the present invention, there is provided a composite profile measuring device for a camshaft that opens and closes an engine valve provided in a cylinder of an internal combustion engine, in accordance with a composite profile of a pair of a fixed cam and a movable cam, comprising a first rotating unit configured to rotate a cylindrical outer shaft on which a fixed cam is provided on an outer circumference thereof, a first phase detecting unit configured to detect a rotational phase of the outer shaft, a second rotating unit configured to rotate an inner shaft arranged rotatably in interior of the outer shaft, a second phase detecting unit configured to detect a rotational phase of the inner shaft, a calculating unit configured to calculate a phase difference between rotational phases of the outer shaft and the inner shaft, based on detection results of the first phase detecting unit and the second phase detecting unit, a first contact element configured to be displaced along a diametrical direction of the fixed cam by contacting a cam surface of the fixed cam that is rotated together with the outer shaft, a second contact element configured to be displaced integrally with the first contact element, and be displaced along a diametrical direction of the movable cam by contacting a cam surface of the movable cam that rotates together with the inner shaft, a displacement amount detecting unit configured to detect displacement amounts of the first contact element and the second contact element, and a recording unit configured to record a detection result of the displacement amount detecting unit in association with the phase difference calculated by the calculating unit.

In accordance with the composite profile measuring device according to the present invention, by detecting with the displacement amount detecting unit the displacement amounts of the first contact element and the second contact element corresponding to the composite profile, it is possible to directly measure the composite profile of the fixed cam and the movable cam. Consequently, it is possible to obtain and evaluate the composite profile easily and efficiently, and with high precision.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Preferred embodiments of a composite profile evaluating method and a composite profile measuring device according to the present invention will be described in detail below with reference to the accompanying drawings.

Figure 1:
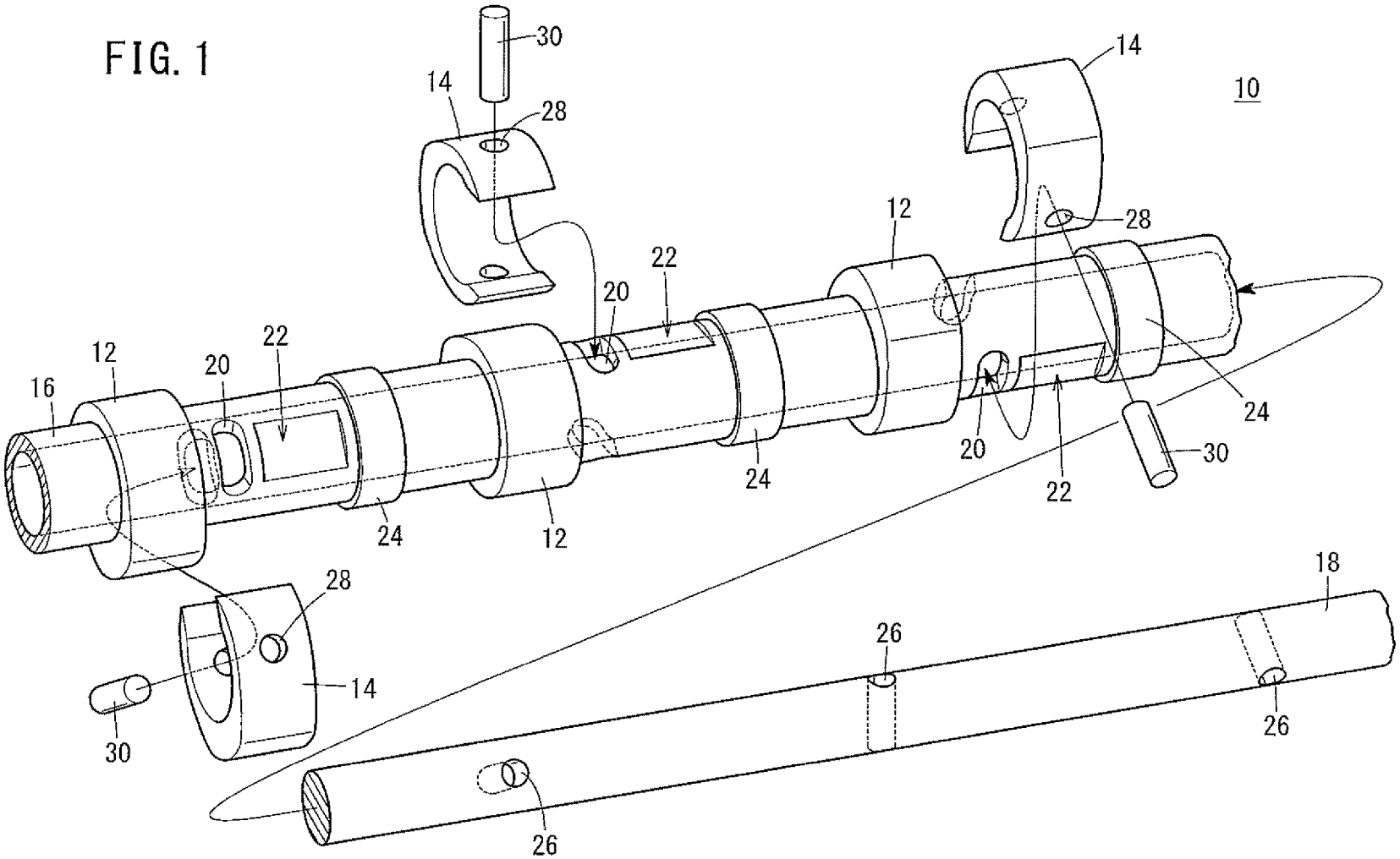
FIG. 1 is an outline exploded perspective view of a camshaft to which there is applied a composite profile evaluating method and a composite profile measuring device according to an embodiment of the present invention.
Figure 2:
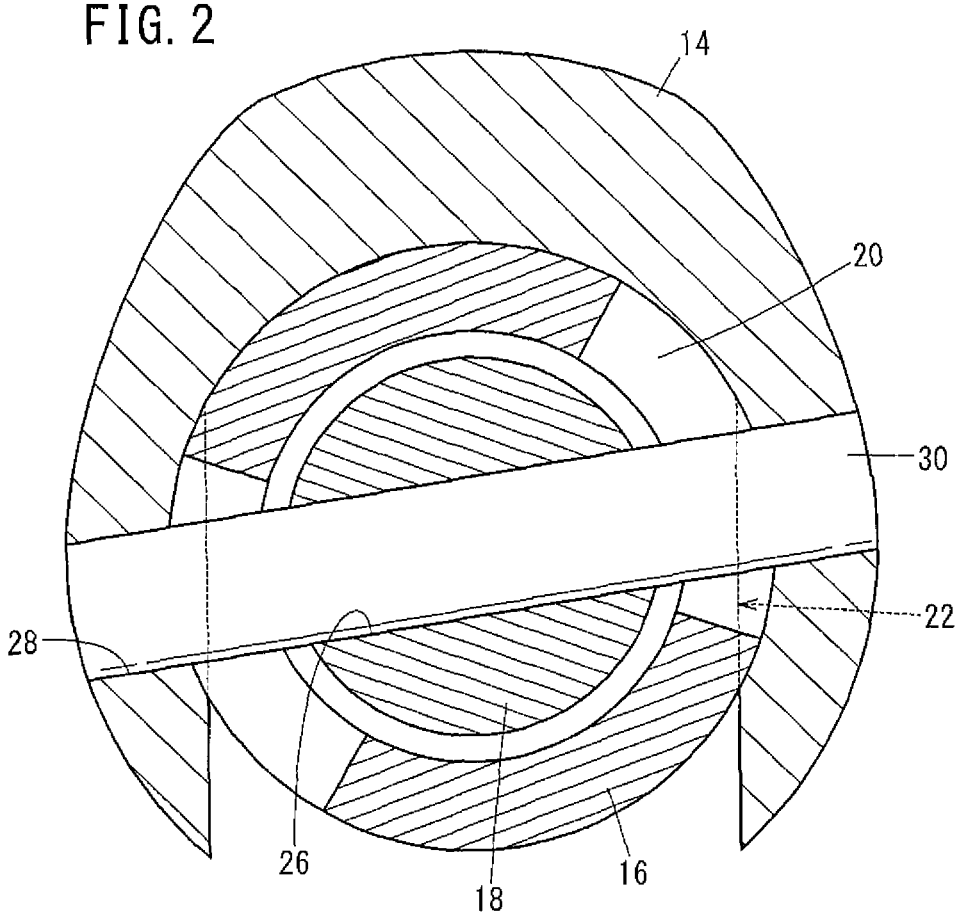
FIG. 2 is a schematic cross-sectional view of a region where a movable cam of the camshaft of FIG. 1 is fixed.

A composite profile evaluating method (hereinafter also referred to simply as an evaluating method) according to the present embodiment and a composite profile measuring device 100 (hereinafter also referred to simply as a measuring device 100, see FIG. 4) can be suitably applied, for example, with respect to a camshaft 10 shown in FIGS. 1 and 2. Thus, at first, with reference to FIGS. 1 and 2, a description will be given concerning the camshaft 10.

The camshaft 10 is used in an internal combustion engine (not shown) having three cylinders, and intake valves or exhaust valves (i.e., engine valves, none of which are shown) provided in the respective cylinders are each opened and closed through one pair of a fixed cam 12 and a movable cam 14. Therefore, a total of three pairs of fixed cams 12 and movable cams 14 are provided.

One pair of the fixed cam 12 and the movable cam 14 are arranged adjacent to each other along the axial direction of the camshaft 10, and serve to drive the same rocker arm (not shown). Stated otherwise, by using a composite profile of the fixed cam 12 and the movable cam 14, the cam profile can be made variable in a simulated manner. For this reason, basically, the profile of the fixed cam 12 is used, whereas concerning the profile of the movable cam 14, only a portion thereof is used that is shifted in phase with respect to the fixed cam 12.

The camshaft 10 is equipped with a cylindrical outer shaft 16, with the fixed cams 12 being formed integrally on the outer circumference thereof, an inner shaft 18, which is arranged rotatably in the interior of the outer shaft 16, and the movable cams 14, which are fixed to the inner shaft 18.

The fixed cams 12 are constituted from three individual members, which are disposed at predetermined intervals along the axial direction of the outer shaft 16. Three pairs of notches 20, which are disposed respectively adjacent to locations where the three fixed cams 12 are provided, are formed on the outer shaft 16. Each of the pairs of notches 20 faces one another mutually in the diametrical direction of the outer shaft 16. Each of the notches 20 is of an arcuate shape extending along the circumferential direction of the outer shaft 16.

Among the locations on both sides adjacent to the notches 20 of the outer shaft 16, narrow diameter portions 22 are formed respectively on sides opposite to the fixed cams 12. The narrow diameter portions 22 are locations at which opposite ends in the diametrical direction of the outer circumferential wall of the outer shaft 16 are cutout in order to partially reduce the outer diameter of the outer shaft 16. Further, journal portions 24 are provided, respectively, at locations away from the narrow diameter portions 22 of the outer shaft 16 on opposite sides from the notches 20. The journal portions 24 are rotatably supported with respect to a cylinder head (not shown) of the internal combustion engine.

The inner shaft 18 is a solid round bar having a smaller diameter than the inner diameter of the outer shaft 16. Therefore, by disposing the inner shaft 18 coaxially in the interior of the outer shaft 16, a clearance is formed mutually between the inner circumferential surface of the outer shaft 16 and the outer circumferential surface of the inner shaft 18. Further, three pin holes 26, which serve as through holes that extend along the diametrical direction of the inner shaft 18, are provided at intervals along the axial direction of the inner shaft 18.

The movable cams 14 are substantially C-shaped in cross section, and in which an opening is provided between both ends in the circumferential direction thereof. The movable cams 14 are constituted from three individual members which are slidably mounted along the circumferential direction, respectively, at locations adjacent to the fixed cams 12 of the outer shaft 16. The distance between both end portions that form the openings of the movable cams 14 is slightly greater than the outer diameter of the narrow diameter portions 22 of the outer shaft 16, and less than the outer diameter of locations of the outer shaft 16 where the movable cams 14 are mounted.

In accordance therewith, after inserting the narrow diameter portions 22 of the outer shaft 16 into the movable cams 14 through the openings, and by sliding the movable cams 14 along the axial direction of the outer shaft 16, the movable cams 14 can be installed at positions adjacent to the fixed cams 12. At this time, because the length of the movable cams 14 in the circumferential direction is set so as to cover one half (180 degrees) or more in the circumferential direction of the outer shaft 16, detachment or separation of the movable cams 14 from the outer shaft 16 can be prevented.

As described above, in the camshaft 10, the profiles of the movable cams 14 are used only for portions whose phases are shifted with respect to the fixed cams 12. Therefore, by forming the movable cams 14 to be substantially C-shaped in cross section, with the locations thereof at which the profiles are not used being provided as openings, the weight of the movable cams 14 can be reduced in comparison with a cylindrically shaped inner cam. Further, costs can be reduced by reducing the amount of material required to form the movable cams 14. Furthermore, by forming the movable cams 14 to be substantially C-shaped in cross section, the movable cams 14 can be installed with respect to the outer shaft 16 from the diametrical direction thereof, after the fixed cams 12 have been provided thereon. Therefore, it is possible to simplify the manufacturing process for the camshaft 10, and to enhance efficiency.

In each of the movable cams 14, a pair of insertion holes 28 are formed that face the notches 20 and the pin holes 26 when the movable cams 14 are installed on the outer shaft 16 in the aforementioned manner. As shown in FIG. 2, the movable cams 14 are fixed to the inner shaft 18 by press-fitting of pins 30 into the pin holes 26 through the insertion holes 28 and the notches 20. As a result, the movable cams 14 are capable of rotating together with the inner shaft 18.

Figure 3:
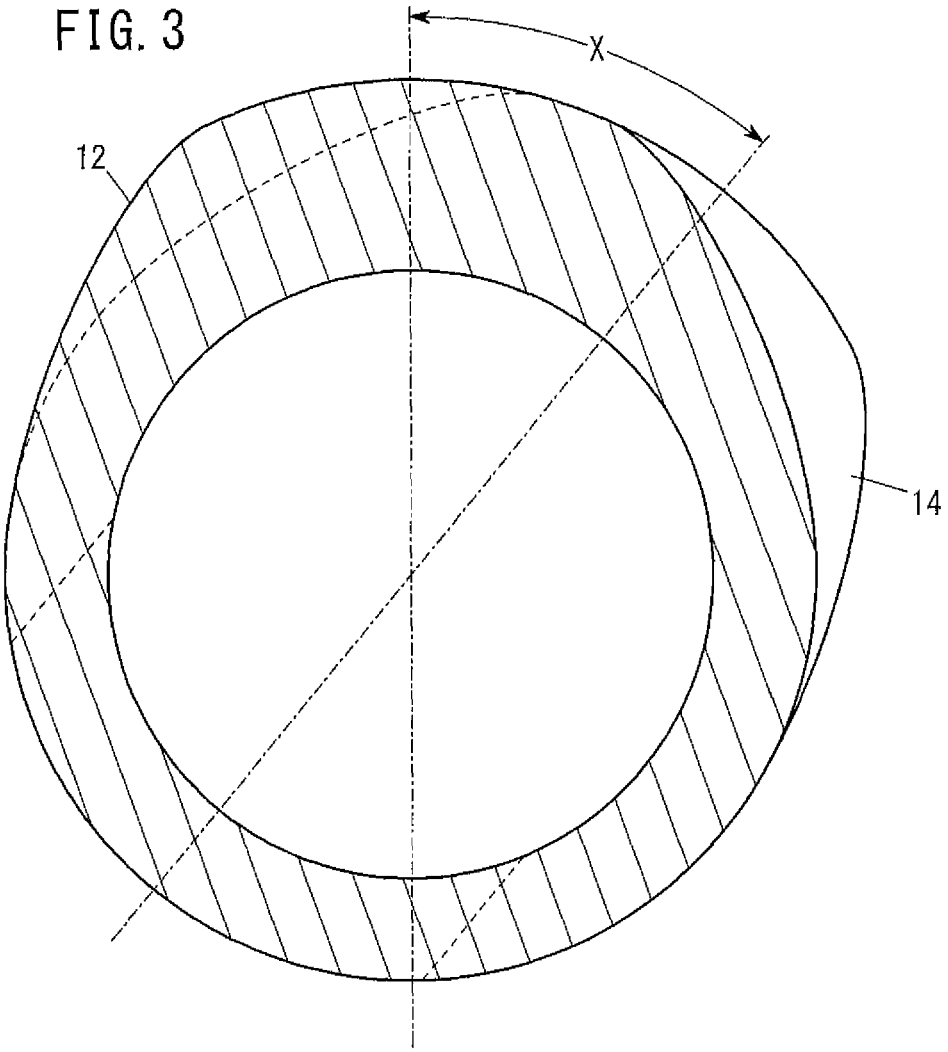
FIG. 3 is an explanatory diagram indicating a state in which phases of a fixed cam and a movable cam are shifted.

More specifically, by rotating the inner shaft 18 relatively with respect to the outer shaft 16, the movable cams 14 rotate in following relation (i.e., in co-rotation) with the inner shaft 18, and slide in the circumferential direction along the outer circumferential surface of the outer shaft 16. As a result, as shown in FIG. 3, the movable cams 14 are displaced relatively in the directions of the arrow X with respect to the fixed cams 12, and the relative positioning (phase difference) therebetween can be made variable. Stated otherwise, a composite profile, which is determined based on the relative positioning of the fixed cams 12 and the movable cams 14, can also be made variable.

As noted above, with the camshaft 10, the same rocker arm is driven by the fixed cam 12 and the movable cam 14, and therefore, by changing the composite profile in the foregoing manner, the cam profile can be made variable in a simulated manner. More specifically, by rotating the inner shaft 18 relatively with respect to the outer shaft 16, the relative positioning between the fixed cam 12 and the movable cam 14 can be adjusted, whereby it is possible to arbitrarily control the timing (opening angle) at which the engine valves are opened and closed.

Figure 4:
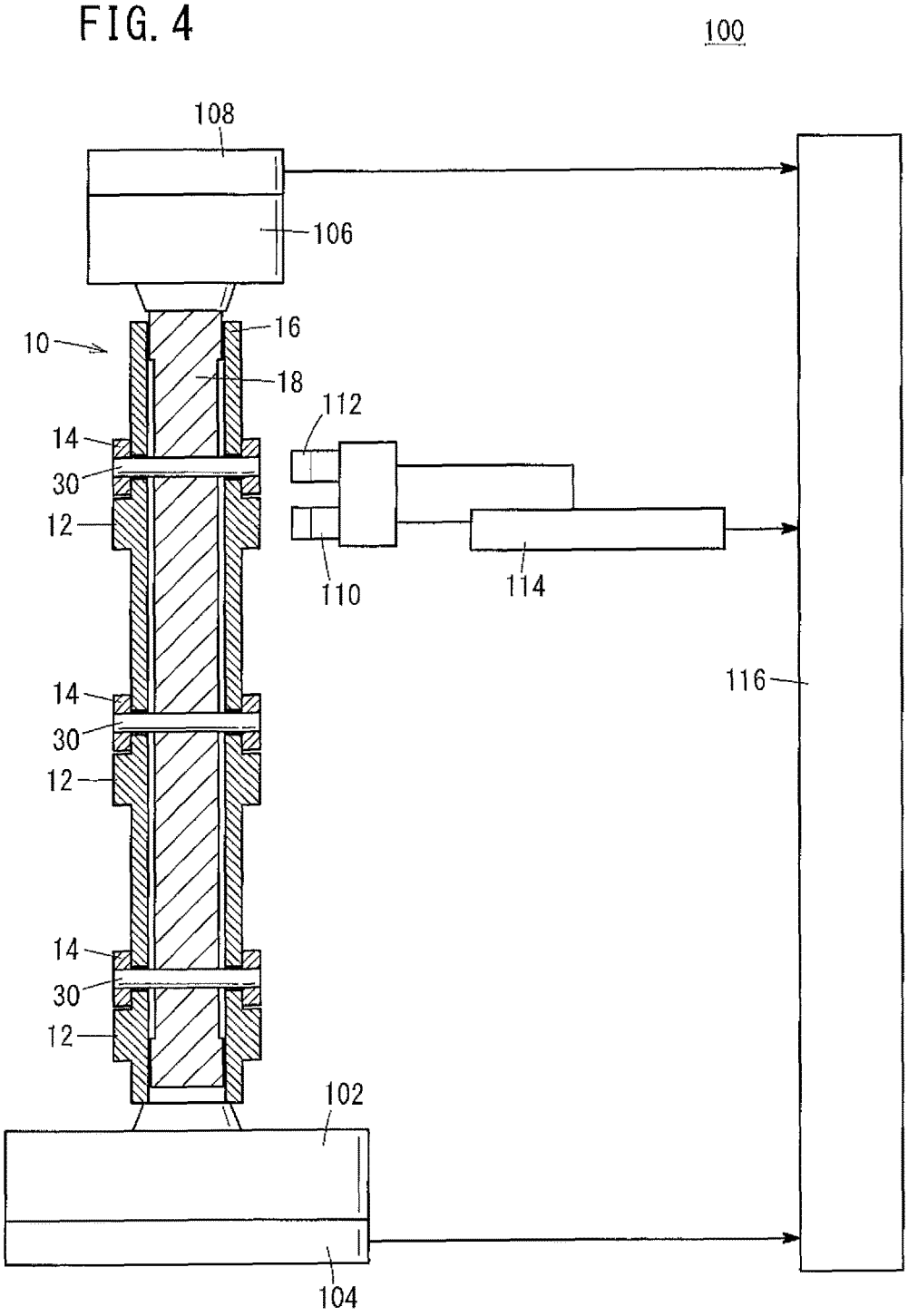
FIG. 4 is a schematic structural diagram of a composite profile measuring device according to an embodiment of the present invention.

As shown in FIG. 4, concerning the camshaft 10, the measuring device 100 according to the present embodiment serves to measure the actual composite profiles of the fixed cams 12 and the movable cams 14.

More specifically, the measuring device 100 is equipped with a first rotating means (first rotating unit) 102, a first phase detecting means (first phase detecting unit) 104, a second rotating means (second rotating unit) 106, a second phase detecting means (second phase detecting unit) 108, a first contact element 110, a second contact element 112, a displacement amount detecting means (displacement amount detecting unit) 114, and a computer 116 including a calculating means (calculating unit) and a recording means (recording unit).

When measurement of the composite profile is carried out, it is desirable that the camshaft 10 be set rotatably between the first rotating means 102 and the second rotating means 106, such that the axial direction thereof lies along a vertical direction. In this case, differently from the case of setting the camshaft 10 along a horizontal direction, since bending or flexure due to gravity or the like at a central side in the axial direction of the elongate camshaft 10 can be avoided, the measurement accuracy of the composite profile can be improved.

The first rotating means 102 is a motor arranged at the lower end side of the camshaft 10, and which rotates only the outer shaft 16. The first phase detecting means 104 is a rotary encoder for detecting the rotational phase of the outer shaft 16. The second rotating means 106 is a motor arranged at the upper end side of the camshaft 10, and which rotates only the inner shaft 18. The second phase detecting means 108 is a rotary encoder for detecting the rotational phase of the inner shaft 18.

Detection results from the first phase detecting means 104 and the second phase detecting means 108 are transmitted to the computer 116. In accordance therewith, based on the detection results from the first phase detecting means 104 and the second phase detecting means 108, the calculating means of the computer 116 calculates the phase difference between the outer shaft 16 and the inner shaft 18.

The first contact element 110 is displaced along the diametrical direction by contacting the cam surface of the fixed cam 12 that rotates together with the outer shaft 16. The second contact element 112 is displaced along the diametrical direction by contacting the cam surface of the movable cam 14 that rotates together with the inner shaft 18. Further, since the first contact element 110 and the second contact element 112 are mutually and integrally displaced, when either one of them is displaced, the other one is also displaced in accordance with the displacement thereof. The displacement amount detecting means 114 is a linear encoder that detects the amounts of displacement of the first contact element 110 and the second contact element 112.

More specifically, in a state in which the phases of the fixed cam 12 and the movable cam 14 are shifted, within the cam surface of the movable cam 14, the second contact element 112 contacts only the portion whose phase is shifted from the fixed cam 12. Further, in this manner, the first contact element 110 is separated from the fixed cam 12 only within an area where the second contact element 112 contacts the movable cam 14. Consequently, the first contact element 110 contacts only that portion where the profile of the cam surface of the fixed cam 12 is used, and the second contact element 112 contacts only that portion where the profile of the cam surface of the movable cam 14 is used. Therefore, the first contact element 110 and the second contact element 112 are displaced corresponding to the composite profile that is actually used, and by detecting the displacement amounts thereof with the displacement amount detecting means 114, it is possible to directly measure the composite profile.

The detection result of the displacement amount detecting means 114 is transmitted to the computer 116. In accordance therewith, the recording means of the computer 116 records the composite profile detected by the displacement amount detecting means 114 in association with the phase difference between the rotational phases of the outer shaft 16 and the inner shaft 18 as calculated by the calculating means.

The measuring device 100 according to the present embodiment is basically constructed in the manner described above. Next, the evaluating method according to the present embodiment will be described in relation to operations of the measuring device 100.

At first, the camshaft 10 of the measuring device 100 is set by attaching the inner shaft 18 to the second rotating means 106, together with attaching the outer shaft 16 to the first rotating means 102. Next, by rotating the first rotating means 102 and the second rotating means 106, the outer shaft 16 and the inner shaft 18 are rotated relatively with respect to each other, whereby an adjustment process is carried out to adjust the relative positioning between one pair of the fixed cam 12 and the movable cam 14.

Thereafter, at least one of the first contact element 110 and the second contact element 112 is brought into contact with the fixed cam 12 or the movable cam 14. In this state, the outer shaft 16 and the inner shaft 18 are rotated by the first rotating means 102 and the second rotating means 106, so as to maintain the relative positioning between the fixed cam 12 and the movable cam 14, which have been adjusted in the foregoing manner. At this time, a phase detecting process is carried out by the first phase detecting means 104 and the second phase detecting means 108 to detect the respective rotational phases of the outer shaft 16 and the inner shaft 18.

Because the fixed cams 12 and the movable cams 14 are rotated together with rotation of the outer shaft 16 and the inner shaft 18, the first contact element 110 and the second contact element 112 are displaced corresponding to the composite profile of the fixed cam 12 and the movable cam 14. A composite profile detecting process is carried out to obtain the composite profile, by detecting the displacement amounts of the first contact element 110 and the second contact element 112 using the displacement amount detecting means 114.

Next, a phase difference calculating process is carried out by the calculating means in order to calculate a phase difference in the rotational phases, on the basis of the respective rotational phases of the outer shaft 16 and the inner shaft 18, which were transmitted to the computer 116 from the first phase detecting means 104 and the second phase detecting means 108.

Thereafter, the computer 116 performs a recording process to record in the recording means the composite profile that was transmitted from the displacement amount detecting means 114, and the phase difference of the outer shaft 16 and the inner shaft 18 as calculated by the calculating means. The composite profile and the phase difference are associated with each other.

In accordance with the above, an actual measurement value of the composite profile based on the relative positioning of the fixed cam 12 and the movable cam 14, which were adjusted in the above adjusting process, is obtained by the relationship thereof with the phase difference between the outer shaft 16 and the inner shaft 18. Further, the aforementioned adjusting process and the composite profile detecting process, which are accompanied by the phase detecting process, the phase difference calculating process, and the recording process, preferably are carried out a plurality of times while changing within a variable range the relative positions mutually between one pair of the fixed cam 12 and the movable cam 14. In this instance, the variable range is a range from a state in which the phases of the one pair of the fixed cam 12 and the movable cam 14 coincide with each other, and until the shift in the phase becomes maximum. In accordance with this feature, it is possible to obtain actual measurement values of the composite profile respectively for each of a plurality of relative positions within the variable range.

Furthermore, concerning the remaining two pairs of the fixed cam 12 and the movable cam 14, which are provided on the camshaft 10 as well, by carrying out similar processes to the above a plurality of times, it is possible to obtain actual measurement values of the composite profiles respectively for each of the plurality of relative positions thereof within the variable range.

Consequently, for example, by comparing the composite profile that was obtained in the foregoing manner, and a set value for the composite profile determined based on the relative positioning of the fixed cam 12 and the movable cam 14, it is possible to evaluate the composite profile. More specifically, as the difference between the actual value and the set value of the composite profile becomes smaller, it can be judged that the assembly accuracy of the aforementioned constituent elements in the camshaft 10, and the dimensional accuracy of the cam surfaces, etc., of the fixed cam 12 and the movable cam 14 are higher.

In accordance with the evaluating method and the measuring device 100 according to the present embodiment, by detecting with the displacement amount detecting means 114 the displacement amounts of the first contact element 110 and the second contact element 112 corresponding to the composite profile, it is possible to directly measure and evaluate the composite profile of the fixed cam 12 and the movable cam 14. Therefore, because there is no need to perform a calculating process or the like to combine the profiles of the fixed cam 12 and the movable cam 14 which are measured respectively, the composite profile can be obtained easily and efficiently, and with high precision. Hence, concerning the camshaft 10, it can be investigated easily and with high accuracy whether or not the plural members thereof are assembled with good precision and a predetermined quality as a manufactured product is satisfied, or the like.

The present invention is not limited in particular to the above-described embodiment, and various modifications can'be made thereto without deviating from the essence and gist of the present invention.

For example, in a state in which the phases of the fixed cam 12 and the movable cam 14 coincide, and within a condition in which the phase shift therebetween is maximum, the measuring device 100 may carry out a process of detecting the amounts of displacement of the first contact element 110 and the second contact element 112 during a time that the movable cam 14 is moved relatively with respect to the fixed cam 12.

More specifically, after having set the camshaft 10 in the measuring device 100, by rotating the first rotating means 102 and the second rotating means 106, the outer shaft 16 and the inner shaft 18 are rotated relatively, and the phases of the fixed cam 12 and the movable cam 14 are made to coincide. Instead of the phases of the fixed cam 12 and the movable cam 14 being made to coincide, the shift in phase therebetween may be made maximum. In this state, the outer shaft 16 and the inner shaft 18 are rotated, and the relative position of the fixed cam 12 with respect to the first contact element 110 is set in the manner described later below.

Then, only the inner shaft 18 is rotated by the second rotating means 106 while the outer shaft 16 is fixed. Thus, the movable cam 14 is moved with respect to the fixed cam 12 between the state in which the phases of the fixed cam 12 and the movable cam 14 coincide and the state in which the shift in the phases is maximum.

At this time, the relative position of the fixed cam 12 with respect to the first contact element 110 is set, so that at least a portion of the cam surface of the movable cam 14 comes into contact with the second contact element 112. In this manner, the amounts of displacement of the first contact element 110 and the second contact element 112 accompanying displacement mainly of the second contact element 112 can be detected during a time that the movable cam 14 is moved relatively with respect to the fixed cam 12.

In addition, as noted above, while changing the relative position of the fixed cam 12 with respect to the first contact element 110 within a range in which at least a portion of the cam surface of the movable cam 14 is in contact with the second contact element 112, by performing the above process a plurality of times, it is possible to detect the behavior of the movable cam 14 with respect to the fixed cam 12 when the inner shaft 18 is moved relatively with respect to the outer shaft 16. Thus, in accordance with this technique as well, it is possible to evaluate with high precision the assembly accuracy and the dimensional accuracy, etc., of the camshaft 10.

With the evaluating method and measuring device 100 according to the aforementioned embodiments, although composite profiles were obtained concerning three pairs of fixed cams 12 and movable cams 14 of the camshaft 10, which is used in a three-cylinder internal combustion engine, the present invention is not limited to this feature, and can be applied similarly with any number of pairs of the fixed cam 12 and the movable cam 14.

What is claimed is:

1. A method of evaluating a composite profile of a camshaft that opens and closes an engine valve provided in a cylinder of an internal combustion engine, in accordance with a composite profile corresponding to a relative position of a pair of a fixed cam and a movable cam, wherein in the camshaft, an inner shaft is rotatably arranged in interior of a cylindrical outer shaft on which the fixed cam is provided on an outer circumference thereof, and the movable cam is fixed to the inner shaft through a notch of the outer shaft, the method comprising:

an adjusting step of adjusting the relative position of the fixed cam and the movable cam, by rotating the inner shaft relatively with respect to the outer shaft, and rotating the movable cam together with the inner shaft while sliding along an outer circumferential surface of the outer shaft; and a composite profile detecting step of obtaining the composite profile, by rotating the outer shaft and the inner shaft, while at least one of a first contact element, which is displaced along a diametrical direction of the fixed cam by contacting a cam surface of the fixed cam, and a second contact element, which is displaced integrally with the first contact element together with being displaced along a diametrical direction of the movable cam by contacting a cam surface of the movable cam, is placed in contact with the cam surface of the fixed cam or the movable cam, and by detecting with a displacement amount detecting unit displacement amounts of the first contact element and the second contact element.

2. The method of evaluating the composite profile according to claim 1, further comprising:

a phase detecting step of detecting respective rotational phases of the outer shaft and the inner shaft, during rotation of the outer shaft and the inner shaft in the composite profile detecting step;

a phase difference calculating step of calculating, by a calculating unit, a phase difference between rotational phases of the outer shaft and the inner shaft, which were detected in the phase detecting step; and a recording step of recording the composite profile detected in the composite profile detecting step, and the phase difference calculated in the phase difference calculating step, the composite profile and the phase difference being associated with each other.

3. The method of evaluating the composite profile according to claim 1, wherein, by performing the adjusting step and the composite profile detecting step a plurality of times, within a variable range of the relative positions between the pair of the fixed cam and the movable cam, composite profiles are obtained, respectively, for each of a plurality of the relative positions within the variable range.

4. A composite profile measuring device for a camshaft that opens and closes an engine valve provided in a cylinder of an internal combustion engine, in accordance with a composite profile of a pair of a fixed cam and a movable cam, comprising:

a first rotating unit configured to rotate a cylindrical outer shaft on which a fixed cam is provided on an outer circumference thereof;

a first phase detecting unit configured to detect a rotational phase of the outer shaft;

a second rotating unit configured to rotate an inner shaft arranged rotatably in interior of the outer shaft;

a second phase detecting unit configured to detect a rotational phase of the inner shaft;

a calculating unit configured to calculate a phase difference between rotational phases of the outer shaft and the inner shaft, based on detection results of the first phase detecting unit and the second phase detecting unit;

a first contact element configured to be displaced along a diametrical direction of the fixed cam by contacting a cam surface of the fixed cam that is rotated together with the outer shaft;

a second contact element configured to be displaced integrally with the first contact element, and be displaced along a diametrical direction of the movable cam by contacting a cam surface of the movable cam that rotates together with the inner shaft;

a displacement amount detecting unit configured to detect displacement amounts of the first contact element and the second contact element; and a recording unit configured to record a detection result of the displacement amount detecting unit in association with the phase difference calculated by the calculating unit.

* * * * *